US008715108B2

(12) United States Patent
Clausen et al.

(10) Patent No.: US 8,715,108 B2
(45) **Date of Patent: *May 6, 2014**

(54) QUICK RELEASE CONNECTION SYSTEM FOR GOLF CLUBS

(71) Applicant: Cobra Golf Incorporated, Carlsbad, CA (US)

(72) Inventors: Karl Clausen, Carlsbad, CA (US); Peter L. Soracco, Carlsbad, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/759,653

(22) Filed: Feb. 5, 2013

(65) Prior Publication Data

US 2013/0150175 A1 Jun. 13, 2013

Related U.S. Application Data

(60) Division of application No. 13/442,208, filed on Apr. 9, 2012, now Pat. No. 8,403,772, which is a continuation of application No. 12/984,306, filed on Jan. 4, 2011, now Pat. No. 8,177,657, which is a division of application No. 12/622,207, filed on Nov. 19, 2009, now Pat. No. 7,878,924, which is a continuation of application No. 11/563,224, filed on Nov. 27, 2006, now Pat. No. 7,621,820.

(51) Int. Cl.
*A63B 53/04* (2006.01)

(52) U.S. Cl.
USPC ..... 473/344; 403/345

(58) Field of Classification Search
USPC ..... 473/324, 342, 344, 334–339, 305, 307, 473/309, 288, 298–299; 403/263, 345, 292, 403/297; 285/24, 322, 33, 330
See application file for complete search history.

(56) References Cited

U.S. PATENT DOCUMENTS

| | | | |
|---|---|---|---|
| 1,322,182 | A | 11/1919 | Duncan |
| 1,623,523 | A | 4/1927 | Bourke |
| 1,639,864 | A | 8/1927 | Smith |
| 2,020,679 | A | 11/1935 | Fitzpatrick |
| 3,524,646 | A | 8/1970 | Wheeler |
| 3,975,023 | A | 8/1976 | Inamori |
| 4,078,722 | A | 3/1978 | Luckenbill |
| 4,240,651 | A | 12/1980 | Mariaulle |
| 4,253,666 | A | 3/1981 | Murphy |
| 4,440,424 | A | 4/1984 | Mode |

(Continued)

OTHER PUBLICATIONS

Brent Kelley, About.com, "Equipment Update-KZG GF 4 Driver, Dunlop Balls," Callaway Optifit; www.golf.about.com/od/equipmentreviews/a/equip030906a.htm, Mar. 10, 2006 [Retrieved on Jun. 12, 2006].

(Continued)

*Primary Examiner* — Stephen L. Blau
(74) *Attorney, Agent, or Firm* — Mark S. Leonardo; Brown Rudnick LLP

(57) ABSTRACT

The present invention is directed at a quick release connection system to facilitate customization of golf clubs. It can be used to interchange soleplates quickly and easily. Teeth are disposed on the inside of a frame so that a soleplate may be inserted with minimal resistance, but cannot be removed without specific steps which may require the use of a simple tool. Strengthening and interlock devices are provided to ensure performance quality akin to traditional golf clubs.

10 Claims, 6 Drawing Sheets

(56) References Cited

U.S. PATENT DOCUMENTS

| | | | |
|---|---|---|---|
| 4,506,888 | A | 3/1985 | Nardozzi, Jr. |
| 4,537,403 | A | 8/1985 | Farina |
| 4,712,575 | A | 12/1987 | Lair et al. |
| 5,026,062 | A | 6/1991 | Freeberg |
| 5,039,098 | A | 8/1991 | Pelz |
| 5,141,231 | A | 8/1992 | Cox |
| 5,228,470 | A | 7/1993 | Lair et al. |
| 5,396,687 | A | 3/1995 | Osterman |
| 5,433,442 | A | 7/1995 | Walker |
| 5,890,977 | A | 4/1999 | Taylor |
| 5,947,838 | A | 9/1999 | Tkacs |
| 5,951,411 | A | 9/1999 | Wood et al. |
| 6,062,995 | A | 5/2000 | Murphy et al. |
| 6,138,329 | A | 10/2000 | Johnson |
| D435,614 | S | 12/2000 | Illiano |
| 6,159,108 | A | 12/2000 | de la Pena |
| 6,547,673 | B2 | 4/2003 | Roark |
| 6,620,053 | B2 | 9/2003 | Tseng |
| 6,773,360 | B2 | 8/2004 | Willett et al. |
| 7,621,820 | B2 | 11/2009 | Clausen et al. |
| 7,878,924 | B2 | 2/2011 | Clausen et al. |
| 8,177,657 | B2 | 5/2012 | Clausen et al. |
| 2005/0159236 | A1 | 7/2005 | Edel |
| 2005/0227779 | A1 | 10/2005 | Lenhof et al. |
| 2006/0105855 | A1 | 5/2006 | Cackett et al. |
| 2006/0122004 | A1 | 6/2006 | Chen et al. |

OTHER PUBLICATIONS

Callaway Golf, "Optimize Your Driver"; www.callawaygolf.com/de.cg.Features.Optifit.html, 2006 [Retrieved on Jun. 12, 2006].

Cash Acme, "Sharkbite Water Heater Installation Kits," www.cashacme.com/sharkbitewaterheater.html, 2003 [Retrieved on Jun. 12, 2006].

Nakashima Golf, "HTEC Titanium Driver," www.nakashimagolf.com/drivers_htec.htm, 2006 [Retrieved on Jun. 15, 2006].

Tgw.com, "Taylormade TLC Club Weights/Accessories," www.tgw.com/customer/category/product.jsp?Subcategory_IC=5898, 2006 [Retrieved on Jun. 12, 2006].

QUICK RELEASE CONNECTION SYSTEM FOR GOLF CLUBS

FIELD OF THE INVENTION

This application is a divisional of U.S. patent application Ser. No. 13/442,208, filed Apr. 9, 2012, which is continuation of U.S. patent application Ser. No. 12/984,306, filed Jan. 4, 2011, now U.S. Pat. No. 8,177,657, which is a divisional of U.S. patent application Ser. No. 12/622,207, filed Nov. 19, 2009, now U.S. Pat. No. 7,878,924, which is a continuation of U.S. patent application Ser. No. 11/563,224, filed Nov. 27, 2006, now U.S. Pat. No. 7,621,820. Each of these applications are incorporated herein by reference in their entireties.

FIELD OF THE INVENTION

This invention generally relates to golf clubs, and more specifically to golf clubs having an improved connection that provides for interchanging a shaft with a club head. Furthermore, the invention also relates to golf clubs having an improved connection for inserting and removing adjustable weights or other attachments within the club head.

BACKGROUND

In order to improve their game, golfers often customize their equipment to fit their particular swing. Absent a convenient way to make heads and shafts interchangeable, a store or a business offering custom fitting must either have a large number of clubs with specific characteristics, or must change a particular club using a complicated disassembly and reassembly process. If, for example, a golfer wants to try a golf club shaft with different flex characteristics, or use a club head with a different weight, center of gravity, or moment of inertia, in the past it has not been practical to make such changes. Golf equipment manufacturers have been increasing the variety of clubs available to golfers. For example, a particular model of a driver-type golf club may be offered in several different loft angles and lie angles to suit a particular golfer's needs. In addition, golfers can choose shafts, whether metal or graphite, and adjust the length of the shaft to suit their swing. Recently, golf clubs have emerged that allow shaft and club head components, such as adjustable weights, to be interchanged to facilitate this customization process.

One example is U.S. Pat. No. 3,524,646 to Wheeler for a Golf Club Assembly. The Wheeler patent discloses a putter having a grip and a putter head, both of which are detachable from a shaft. Fastening members, provided on the upper and lower ends of the shaft, have internal threads, which engage the external threads provided on both the lower end of the grip and the upper end of the putter head shank to secure these components to the shaft. The lower portion of the shaft further includes a flange, which contacts the upper end of the putter head shank, when the putter head is coupled to the shaft. This design produces an unaesthetic bulge at the top of the shaft and another unaesthetic bulge at the bottom of the shaft.

Another example is U.S. Pat. No. 5,433,442 to Walker for Golf Clubs with Quick Release Heads. The Walker patent discloses a golf club in which the club head is secured to the shaft by a coupling rod and a quick release pin. The upper end of the coupling rod has external threads that engage the internal threads formed in the lower portion of the shaft. The lower end of the coupling rod, which is inserted into the hosel of the club head, has diametric apertures that align with diametric apertures in the hosel to receive the quick release pin.

Another example is U.S. Patent Pub. No. 2006/0105855 A1 to Cackett et al. for a Golf Club with Interchangeable Head-Shaft Connections. The Cackett publication discloses a golf club that uses a sleeve/tube arrangement instead of a traditional hosel to connect the interchangeable shaft to the club head in an effort to reduce material weight and provide for quick installation. A mechanical fastener (screw) entering the club head through the sole plate is used to removably secure the shaft to the club head.

Still another example is U.S. Pat. No. 6,547,673 to Roark for an Interchangeable Golf Club Head and Adjustable Handle System. The Roark patent discloses a golf club with a quick release for detaching a club head from a shaft. The quick release is a two-piece connector including a lower connector, which is secured to the hosel of the club head, and an upper connector, which is secured to the lower portion of the shaft. The upper connector has a pin and a ball catch that both protrude radially outward from the lower end of the upper connector. The upper end of the lower connector has a corresponding slot formed therein for receiving the upper connector pin, and a separate hole for receiving the ball catch. When the shaft is coupled to the club head, the lower connector hole retains the ball catch to secure the shaft to the club head.

However, the utilization of pins, screws, and/or coupling rods in the attachment of the shaft to club heads has certain drawbacks. The addition of these connection aids may add weight to the clubs, which negatively affects swing speed and moments of inertia, and therefore overall club performance and ball-striking ability. Furthermore, these methods take time to attach and detach. Finally, these connection aids are subject to stripping and/or material failure if exposed to excessive forces either during attachment or during normal club use.

Hence, there remains a need in the art for golf clubs with an improved connection that provides a method for quickly and easily interchanging the shaft, removable weights and other attachments with the club head.

SUMMARY

The invention is directed to a quick release connection system for assembling a golf club. In one embodiment, angularly disposed teeth are arranged on a portion of a golf club within a hosel hole. This portion can be the inner wall of the hosel hole or another part of the golf club. The teeth form an acute angle with the direction of insertion, and when a shaft is inserted into the hole, the teeth allow the shaft to pass by the teeth. When removal of the shaft is attempted, the teeth bite into the outside of the shaft and resist its withdrawal. An optional channel can be scored into the shaft to retain the teeth and to provide added strength to the point of engagement with the teeth. A sliding release collar is adapted to push the teeth radially outward from the shaft so that the teeth are no longer in contact with the shaft and removal of the shaft is permitted. A removing tool is also provided and is adapted to either push or pull the release collar. The connection system includes an optional plug sized and dimensioned to stabilize the shaft. Optional interlock devices are disposed on or within the frame, plug, or shaft and are designed to prevent rotation of the shaft within the connection system.

The inventive connection system can also be used to connect removable weight(s), other attachments including decorative attachments, or a sole plate to the body portion of a golf club head. A second set of angularly disposed teeth can also be provided.

BRIEF DESCRIPTION OF THE DRAWINGS

In the accompanying drawings, which form apart of the specification and are to be read in conjunction therewith and in which like reference numerals are used to indicate like parts in the various views.

DETAILED DESCRIPTION

Figure 1:
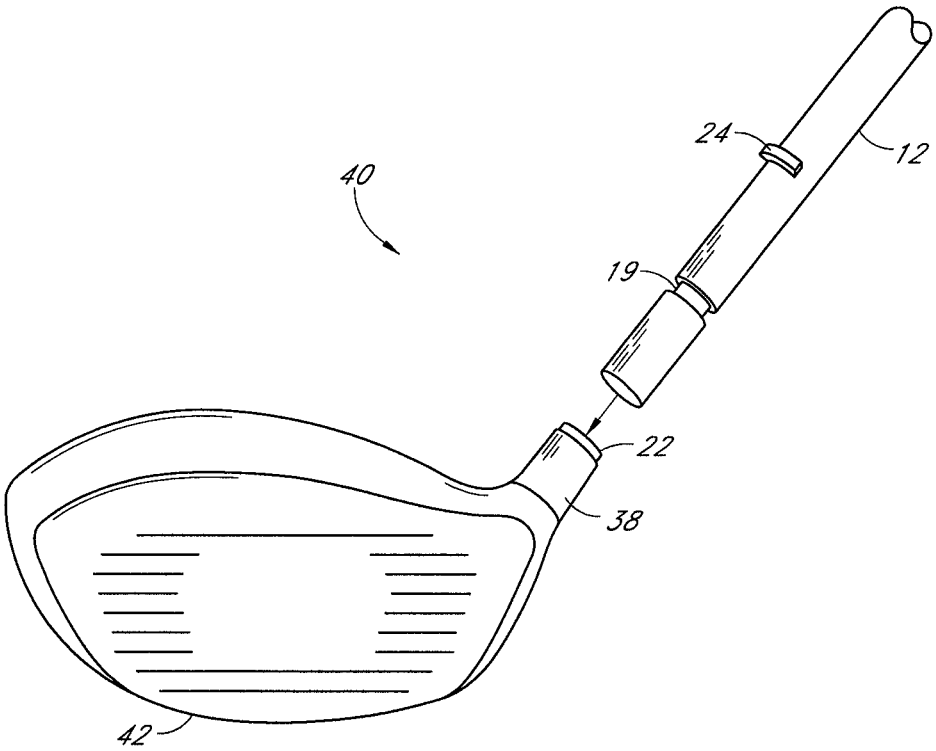
FIG. 1 shows a perspective view of a golf club equipped with the quick release connection system of the present invention.

The present invention is directed to a quick release connection system for assembling and disassembling golf clubs. Such a system can be utilized or customized for various applications, including, but not limited, to the shaft-club head connection, the insertion of adjustable weights in the club head, and the connection of a sole plate to the club head. Several embodiments of the present invention are described below.

In one embodiment, the present invention is directed to a quick release connection system for connecting a golf club shaft to a club head. The quick release connection system comprises a golf club shaft and a hosel of a golf club head with an opening sized and dimensioned to receive the shaft. Preferably, the hosel opening comprises a frame surrounding an open area and a plurality of angularly disposed teeth that extend from a frame into the open area, so that when a shaft is inserted, contact is made between the teeth and the shaft. The teeth are angled toward the sole or heel of the club, such that they do not obstruct the insertion of the shaft into the hosel opening, but may give or bend as the shaft passes through. The teeth form an acute angle with the direction of insertion, e.g., the angle between the shaft and the teeth that faces toward the opening of the hole is less than 90 degrees. The teeth are preferably arranged in a ring, but are not limited to any singular arrangement. When the shaft is removed by pulling it from the club head, the teeth will bite into the outside of the shaft and prevent its removal. In order to remove the shaft, a release tool is attached around the shaft and pushes against a cylindrical release collar slidingly connected to the shaft or the hosel. When pressed by the release tool on the outer end, the release collar pushes the teeth away from the shaft. Once this contact is broken, the shaft can be removed. Alternatively, the release tool is sized and dimensioned to directly push or pull the teeth away from the shaft.

Additionally, the interior of the connection system can be sealed off at one end by a shaft stopper. An optional brace plug may also extend from the shaft stopper to fit within the end of the shaft to provide additional mechanical support. In order to prevent the shaft from rotating within the frame of the connection system, one or more interlock devices may be disposed on or within the connection system, i.e., on the frame, shaft stopper, brace plug, shaft, or any combination thereof. Suitable anti-rotational devices include keyway or key/spline systems. Extra row(s) of teeth may also strengthen the connection between the shaft and the connection system, helping to hold the shaft in place. Another suitable method for strengthening this connection is to optionally score a line or ring on the golf club shaft to secure the teeth on the scored line.

This embodiment and other embodiments, including but not limited to connection systems for adding removable weights or sole plates to the club head, are described in detail below.

FIG. 1 shows an exemplary embodiment of the present invention applied to a golf club 40. A frame portion of the connection system, not shown, is disposed or integrated within hosel 38 of golf club head 42. Shaft 12 is inserted into the frame within hosel 38, passing through release collar 22, which is slidingly connected to the frame and around shaft 12, and protrudes out from within hosel 38. Optional scored line 19 is cut out of shaft 12 to facilitate attachment to the frame. The optional scored line 19 can be a gap between the end of shaft 12 and the top of plug 18. To release shaft 12, release tool 24 is placed around shaft 12 and pushed against release collar 22, as described above and in more detail below.

Figure 2:
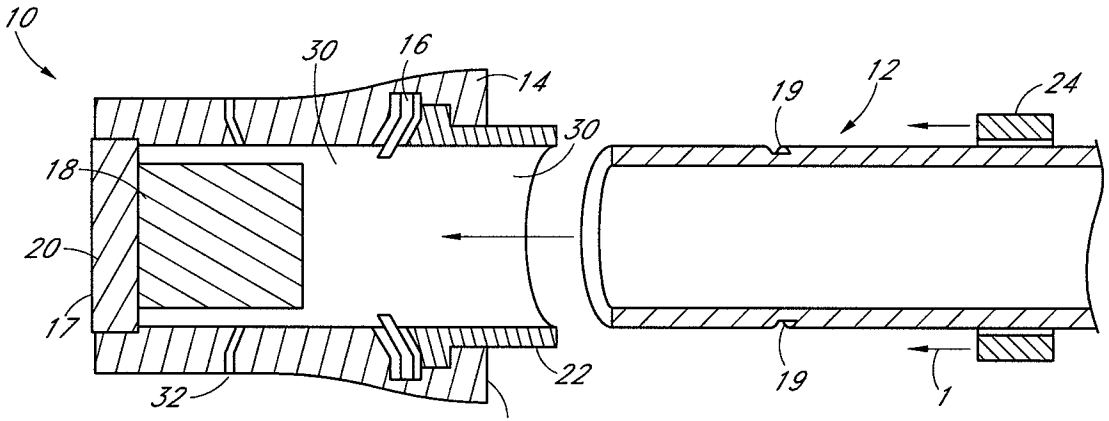
FIG. 2 shows a cross-sectional view of the quick release connection system according to one embodiment of the present invention prior to the insertion of a shaft.
Figure 2A:
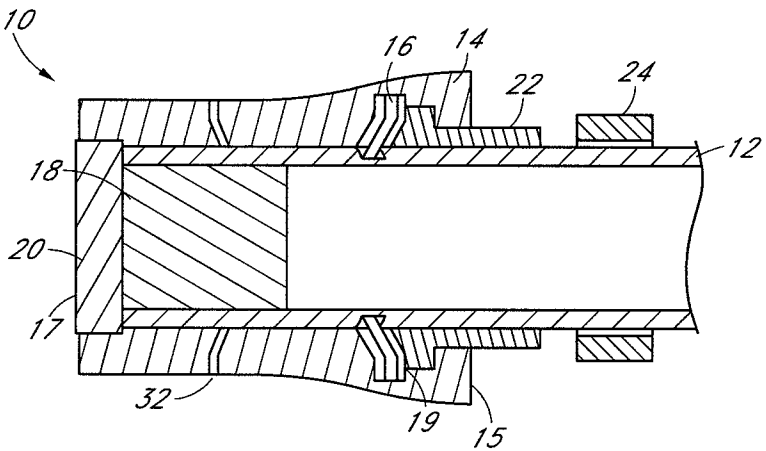
FIG. 2*a* shows a cross-sectional view of the quick release connection system according to one embodiment of the present invention after insertion of the shaft.

FIGS. 2 and 2*a* illustrate the quick release connection system 10 according to the present invention. Shaft 12 is inserted in the opening 30 of frame 14. As shaft 12 passes inside frame 14 at proximal end 15, it contacts teeth 16, but its movement is not obstructed because teeth 16 are mounted angularly relative to a longitudinal axis of frame 14 and shaft 12, and toward distal end 17. Distal end 17 is disposed proximate to the heel of club head 42. To ease insertion into opening 30, shaft 12 may be tapered at the insertion end. Shaft 12 can be pushed around optional brace plug 18 all the way up to contact with shaft stopper 20. Optional brace plug 18 stabilizes shaft 12 within frame 14. At least one shaft interlock system may align and lock shaft 12 to frame 14 to minimize any relative rotation between shaft 12 and the frame 14. Suitable interlock systems include, but are not limited to, key and spline systems oriented along the shaft axis.

Figure 5:
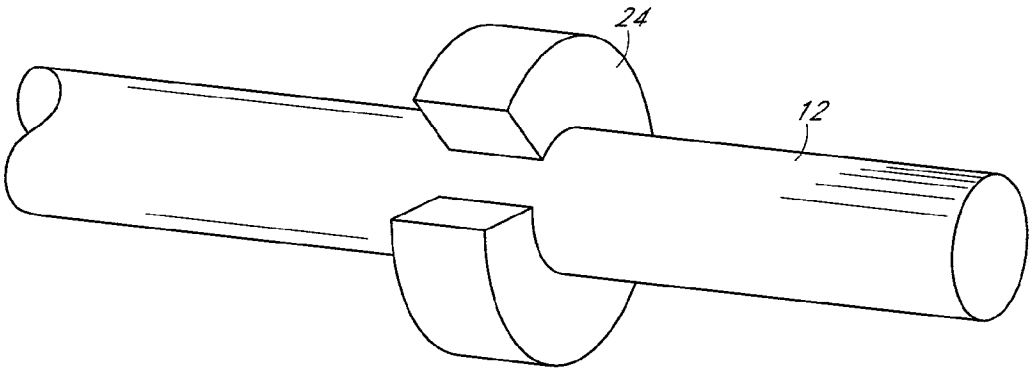
FIG. 5 shows a perspective view of a release tool and a shaft of the present invention.

To remove shaft 12 from frame 14, release tool 24 is preferably used in conjunction with release collar 22, which is slidingly attached to frame 14 or is an extension of frame 14. Release tool 24 is placed around shaft 12 and is moved distally along arrows 1 until it comes in contact with release collar 22. As release tool 24 is moved further distally along arrows 1, release collar 22 is moved in the same direction, contacting teeth 16. Teeth 16 are then moved radially outward away from shaft 12. When teeth 16 are no longer in contact with shaft 12, shaft 12 can be removed from connection system 10. In order to prevent re-engagement between teeth 16 and shaft 12, release tool 24 is pressed against release collar 22 during the removal of shaft 12. Preferably, release tool 24 has a U-shape so that it can be readily positioned around shaft 12 and removed therefrom, as shown in FIG. 5. In an alternative embodiment, release collar 22 is constructed to be wide enough around shaft 12 such that a person may be able to manually push in release collar 22 to disengage teeth 16 without the use of release tool 24. For example, release collar 22 may include a lip or another user-actuated handle.

Figure 3:
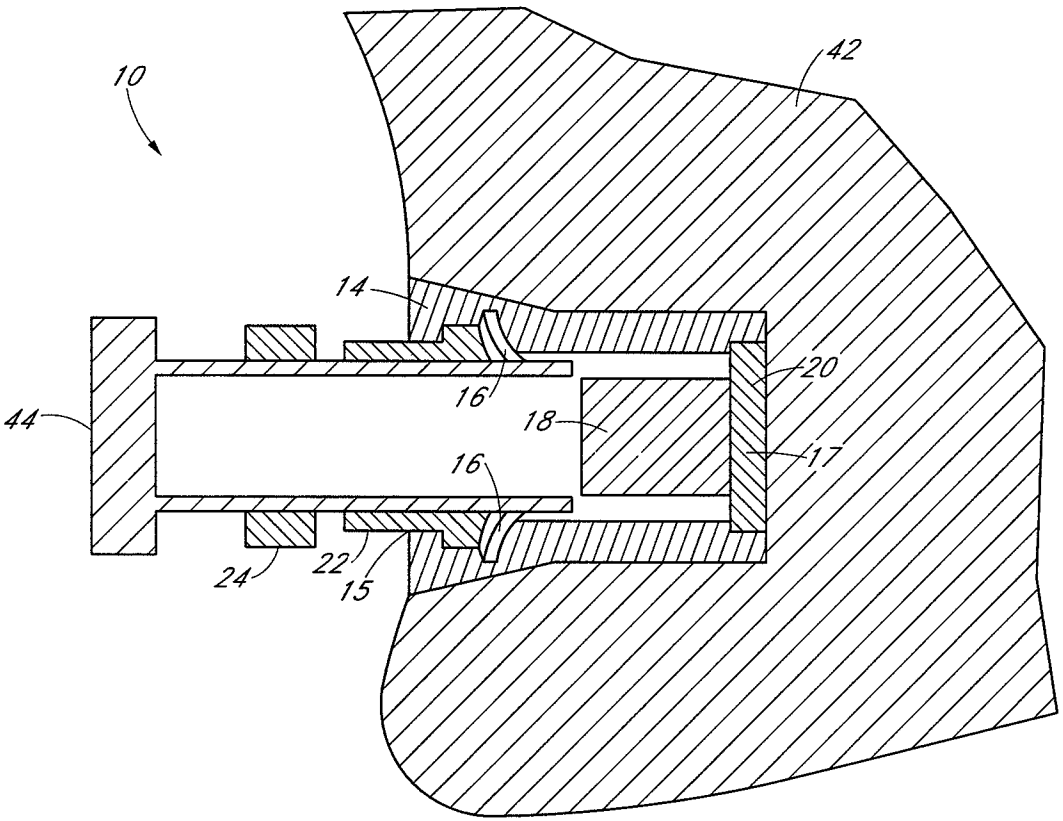
FIG. 3 shows a cross-sectional view of the quick release connection system of the present invention disposed in a club head body.

Yet another embodiment of the invention is directed at a quick release connection system for adjustable, removable weights that can be inserted into a golf club head, and is shown in FIG. 3. This embodiment is similar to the embodiment shown in FIGS. 1, 2, and 2*a*, except that the shaft is replaced by a removable weight and the connection system comprises an insertion hole in the club head. Sizes and materials of shaft, frame, and teeth, as recognized by those in the art, can vary according to the different force and strength requirements of the club head. In this embodiment, frame 14 is integrated within the body of golf club head 42 and is adapted to receive a removable weight 44, which can be hollow or solid. Connection system 10 is not limited to any one location within the body of club head 42, and there can be multiple connection systems 10 integrated within a single club head 42. Placing removable weights in different locations within the club head allows golfers to adjust the trajectory of their shots by changing the center of gravity and the moment of inertia. For example, placing a heavy removable weight toward the bottom and rear of the club head moves the center of gravity in the same direction, permitting the golfer to hit a ball with a higher launch angle. This also increases the moment of inertia, increasing the size of the sweet spot and minimizing the chances that an off-center hit will result in a poor shot. Similar to FIGS. 2 and 2*a*, teeth 16 bite into the side of removable weight 44 once it has been inserted to prevent removal without release tool 24. Similar to previous embodiments, in order to remove the removable weight 44, the release tool 24 is pushed against release collar 22 to disengage teeth 16 from contact with weight 44.

Figure 4:
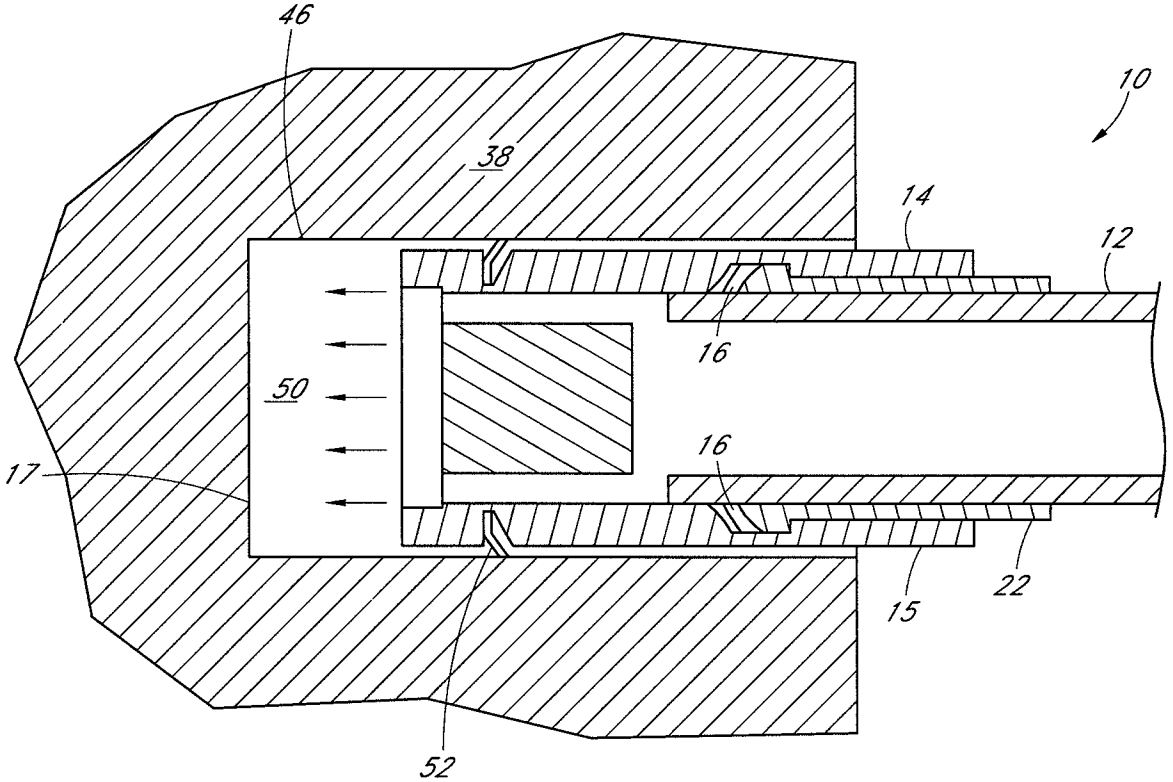
FIG. 4 shows a cross-sectional view of the quick release connection system according to another embodiment of the present invention.

Another embodiment of the present invention is similar to the embodiment shown in FIGS. 1, 2, 2*a*, and 3, except that connection system 10 is separate from and is removably disposed within a hosel or insertion hole of the golf club head, not integrated with the walls of the hosel or insertion hole. In this embodiment, a plurality of teeth may be disposed on the outside of frame 14 to connect connection system 10 to the inside of the hosel. FIG. 4 shows a cross-sectional view of quick release connection system 10 according to this embodiment, separate from and being inserted into opening 50. Opening 50 may be an opening in a hosel, an insertion hole, or any other similar opening known in the art. This embodiment preferably uses teeth as seen in the previous embodiments to attach connection system 10 within opening 50. Connection system 10 may be inserted into opening 50 either before or after shaft 12 is inserted into connection system 10. As shaft 12 passes inside frame 14 at proximal end 15, it contacts teeth 16, but its movement is not obstructed because teeth 16 are mounted angularly relative to a longitudinal axis of frame 14 and shaft 12, and toward distal end 17 as described above. Release collar 22 or an extension thereof is slidingly attached to frame 14. In the insertion of connection system 10, as frame 14 is pushed into opening 50, mounting teeth 52 make contact with the walls 46 of opening 50, but movement of the connection system is not obstructed because mounting teeth 52 are mounted angularly relative to a longitudinal axis of frame 14 and walls 46. However, if one attempts to remove connection system 10, mounting teeth 52 will bite into the walls of opening 50 and prevent removal in that direction. While shaft 12 may be removed by pushing a release tool (not shown in FIG. 4) against release collar 22 as in the embodiment shown in FIGS. 2 and 2*a*, removal of the entire connection system 10 can only be accomplished using a different release tool, such as a pull ring instead of a push ring.

This embodiment can also be applied to adjustable, removable weights disposed within the club head. In such an embodiment, shaft 12 is replaced by a removable weight 44, and frame 14 is disposed inside an insertion hole 48 in the club head. As with the preceding embodiments, sizes and materials of the shaft, frame, and teeth, as recognized by those skilled in the art, can vary according to different force and strength requirements.

Figure 6:
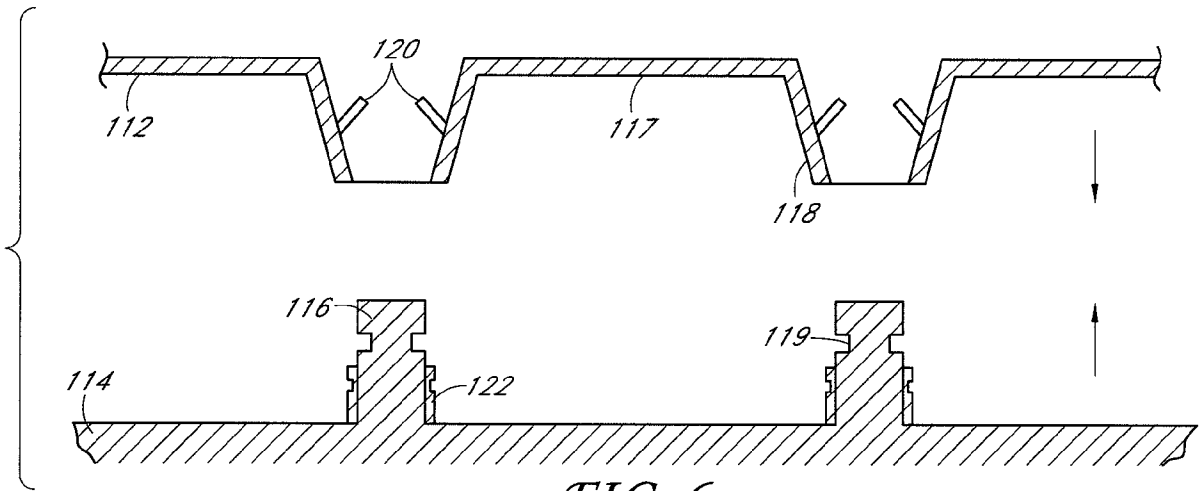
FIG. 6 shows a cross-sectional view of the quick release connection system according to another embodiment of the present invention prior to connection.
Figure 6A:
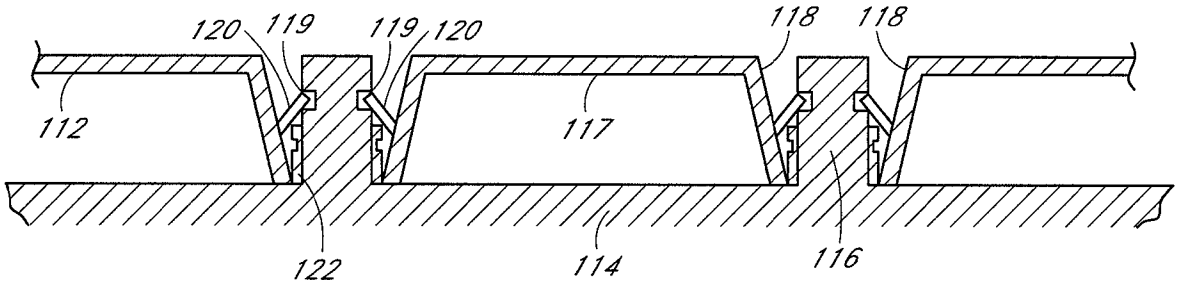
FIG. 6*a* shows a cross-sectional view of the quick release connection system according to the embodiment shown in FIG. 6 after connection.

In another embodiment of the present invention, as depicted in FIGS. 6 and 6*a*, the quick connection system 110 is used to removably connect a soleplate 112 to a golf club head body 114. Soleplate 112 may be used to enhance the various performance characteristics of a golf club when attached to club head body 114, such characteristics include, but are not limited to, increasing the moment of inertia and adjusting the center of gravity. Soleplate 112 comprises a flat portion 117 and at least one inverse bore portion 118. A plurality of teeth 120 is preferably angularly attached to each inverse bore portion 118 of soleplate 112 as shown. Club head body 114 preferably comprises at least one bore shaft 116, with each release collar 122 slidingly connected to a bore shaft 116. Each bore shaft 116 also comprises an optional scored line 119 which runs around at least a portion of the circumference of the bore shaft.

To connect soleplate 112 to club head body 114, each inverse bore portion 118 of soleplate 112 is placed over each bore shaft 116 in club head body 114. As soleplate 112 is lowered over bore shaft(s) 116, teeth 120 will make contact with the outside of bore shaft 116. Teeth 120 will contact, slide into, and engage with optional scored line 119 in bore shaft 116, locking soleplate 112 and club head body 114 together.

Figure 8:
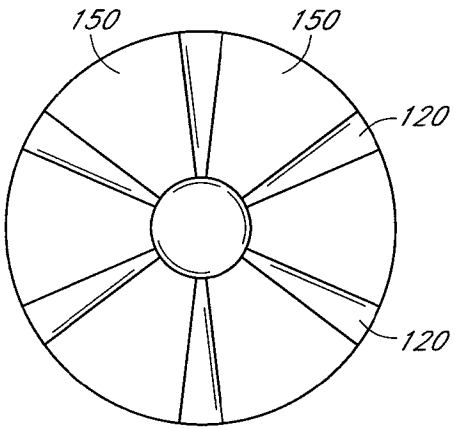
FIG. 8 is a top view of a portion of the embodiment shown in FIGS. 6, 6*a*, and 7.
Figure 7:
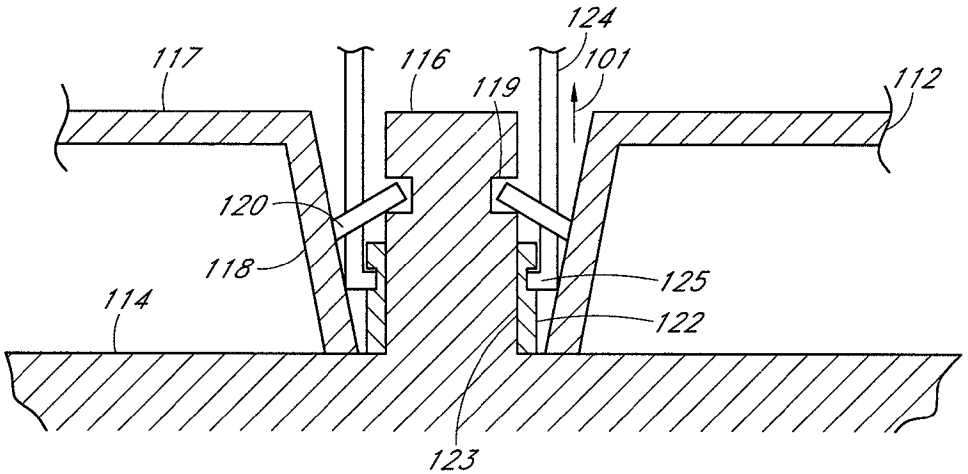
FIG. 7 shows a cross-sectional view of the embodiment shown in FIGS. 6 and 6*a* and the operation of a release tool according to the present invention.

In accordance with the present invention, disassembly of soleplate 112 and club head body 114 is shown in FIG. 7. Release tool 124 is inserted between the teeth 120 so that hooked portion 125 of tool 124 is below second scored line 123 of release collar 122. FIG. 8 is a top view of a portion of the connection system showing teeth 120 engaged with bore shaft 116 and open areas 150 between teeth 120 that tool 124 is inserted into. Referring back to FIG. 7, once inserted between teeth 120, release tool 124 is then pulled along arrow 101. Hooked portion 125 of tool 124 will engage with scored line 123, and tool 124 is continually pulled until release collar 122 makes contact with teeth 120 and disengages teeth 120 from optional scored line 119 of bore shaft 116. Once teeth 120 are disengaged from and no longer in contact with scored line 119, soleplate 112 can be removed from club head body 114.

While it is apparent that the illustrative embodiments of the invention disclosed herein fulfill the objectives stated above, it is appreciated that numerous modifications and other embodiments may be devised by those skilled in the art. Therefore, it will be understood that the appended claims are intended to cover all such modifications and embodiments, which would come within the spirit and scope of the present invention.

What is claimed is:

1. A golf club head with a releasable sole portion, comprising:

a club head body comprising at least one bore shaft;

a sole portion comprising a flat portion and at least one inverse bore portion including a plurality of teeth, wherein the teeth are sized and dimensioned to bend, wherein the teeth allow the insertion of the at least one bore shaft into the at least one bore portion and resist the withdrawal of the bore shaft from the bore portion, and wherein the teeth form an acute angle with the direction of insertion.

2. The club head of claim 1, further comprising a release collar slidingly connected to the bore shaft.

3. The club head of claim 1, wherein the sole portion is a sole plate.

4. The club head of claim 1, wherein the at least one bore shaft comprises a scored line which runs around at least a portion of the circumference of the bore shaft.

5. The club head of claim 1, further comprising an interlock device comprising a spline.

6. The club head of claim 1, wherein the at least one bore shaft comprises a recess that is configured to receive at least a portion of at least one of the plurality of teeth.

7. The club head of claim 1, wherein the sole portion is used to adjust the moment of inertia of the club head.

8. The club head of claim 1, wherein the sole portion is used to adjust the center of gravity of the club head.

9. A golf club head with a releasable sole portion, comprising:

a club head body;

a removable sole portion; and a mechanism to releasably couple the sole portion to the club head body, the mechanism comprising a plurality of teeth that are uncoupled with a tool incorporated into the sole portion.

10. The club head of claim 9, wherein the sole portion is a sole plate.

* * * * *